United States Patent [19]

Pohjola

[11] Patent Number: 4,919,015

[45] Date of Patent: Apr. 24, 1990

[54] SCREW CAP OPENER

[76] Inventor: Jukka K. Pohjola, Oskelantie 1 A 7, 00320 Helsinki, Finland

[21] Appl. No.: 334,976

[22] PCT Filed: Oct. 30, 1987

[86] PCT No.: PCT/FI87/00145

§ 371 Date: Mar. 29, 1989

§ 102(e) Date: Mar. 29, 1989

[87] PCT Pub. No.: WO88/03511

PCT Pub. Date: May 19, 1988

[30] Foreign Application Priority Data

Apr. 11, 1986 [FI] Finland ..... 864474

[51] Int. Cl.[5] ..... B67B 7/18

[52] U.S. Cl. ..... 81/3.44

[58] Field of Search ..... 81/3.07, 3.4, 3.44

[56] References Cited

U.S. PATENT DOCUMENTS

| | | | |
|---|---|---|---|
| 800,737 | 10/1905 | Graf | 81/3.4 |
| 2,505,738 | 4/1950 | Howell | 81/3.44 |
| 2,589,693 | 3/1952 | Hess | 81/3.4 |
| 2,732,741 | 1/1956 | Muller-Strobel | 81/3.44 |
| 3,600,982 | 11/1969 | Tholen | 81/3.4 |

*Primary Examiner*—Roscoe V. Parker

*Attorney, Agent, or Firm*—Bierman and Muserlian

[57] ABSTRACT

The disclosure relates to a screw cap opener. The structure of the opener is mainly based on a firm cylindrical body (1) inside which there has been installed pressing parts (2) which functions as the gripping means of the screw cap. The device functions so that when it is pressed against the top of the screw cap to be opened the pressing parts start to close strongly squeezing the screw cap from its sides. When the device is twisted, the cap either opens or closes. Structurally the functioning of the device is based on pressing parts which have been installed against the inside surface of the body with an axle so that they can turn vertically at an angle of approx. 25° in a downwardly slanting position close to a horizontal plane. The pressing parts are designed so that above the squeezing section there is an outwardly projecting tip (7), which when pressed against the top of the cap turns the pressing parts upwards so that the distance between them diminishes, the screw cap is squeezed between the pressing parts, and the device is ready for use.

6 Claims, 1 Drawing Sheet

SCREW CAP OPENER

The invention relates to a device for opening screw caps used in bottles. The structure of the device comprises a cylindrical body into which radially pressing parts having an axle at one end, are inserted. When the device is pressed against the top of the bottle cap the pressing parts are forced closer to each other and squeeze the bottle cap from different sides. Thus, when the device is rotated the cap either opens or closes.

Formerly, although screw cap openers which function under the inventive principle were not known, openers resembling tongs and conical forks were. The disadvantage of openers resembling tongs is that they are large and are slow and awkward to handle. Also, setting the opener in the correct position of the cap is difficult and pressing power is hard to control.

When using fork openers, the screw cap is being pushed between a conical fork, often equipped with teeth. The disadvantage of this opener is that it does not grip the cap well and the teeth often puncture the cap so that the cap sticks to the opener.

The characteristic features of the present invention are as follows: The basic structure of the device is formed by a cylindrical body. Against the inside surface of the cylindrical body, pressing parts in a downwardly slanting position are radially installed. The pressing parts are connected to the body with an axle and are located in recesses formed in a firm body so that the pressing parts can easily move in an up and down direction in their recesses. When the device is pressed against the top of the screw cap the pressing parts start to turn upwards at the same time coming closer to each other so the cap is squeezed between the pressing parts.

The accompanying drawings illustrate the inventive screw cap opener in which.

Figure 1:
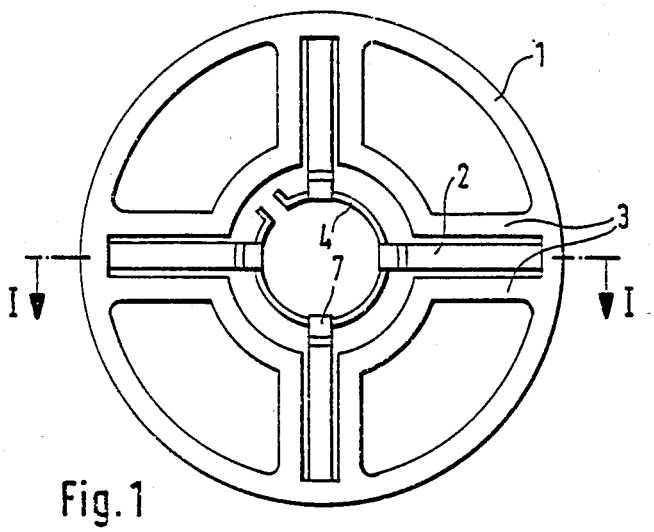
FIG. 1 illustrates the screw cap opener viewed from the bottom so that the lower part of the body has been omitted.
Figure 2:
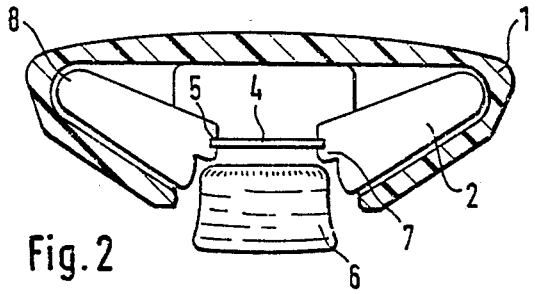
FIG. 2 illustrates the same device as a whole viewed from the side along the line I—I.
Figure 3:
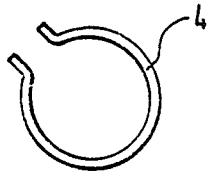
FIG. 3 illustrates a lock spring from the top.

In a firm body 1 is installed pressing parts 2 (in the picture 4 pcs.) so that they can restrictedly turn in a downwardly slanting position to an angle of, for instance, between 155°–180° in transversally square shaped spokes 3 forming recesses, formed inside the body. Between the recesses and the pressing parts there is a slight looseness, for instance 0.1 mm, so that the motion can occur with very little friction. In order to be able to keep the pressing parts in their recesses without falling out, small grooves 5 are built in the tip parts 7 of the pressing parts into which a lock spring 4 (FIG. 3) is installed. The function of the spring is also to return the pressing parts back to a straight position after using the opener. Part 6 denotes a screw cap which does not belong to the opener itself.

The opener is used in the following manner: The opener is pressed against the top of the screw cap. The cap lifts the tip parts 7 of the pressing parts upwards. The pressing parts 2 are equipped with partially circular shaped bearings at opposite ends 8, the inside surface of the body working as the other part of the bearing, so that this combination acts as a sliding-contact bearing. The position of the bearings in the firm body remain constant so that when the cap lifts the pressing parts 2 from their tip parts 7 the distance between the pressing parts begins to decrease and the screw cap is squeezed between the pressing parts the more the distance decreases. The achieved squeezing power is conversely proportional to a cosine function.

The opener can be produced totally of plastic. Moreover the needed pressing parts, the number of which can be 2, 3, or 4 pcs., are similar to each other which also helps the production. By changing the length and the shape of the pressing parts the opener can be used for different sizes of screw caps. With the former procedure the squeezing power against the screw cap can also be adjusted according to the requirements.

By changing the degree of vertical curve of the top of the pressing part the squeezing point can be always set to the section of the screw cap where it is strongest. In this manner the so called checking ring, which is often installed in screw caps, can be easily removed. The squeezing surface of the pressing part can also be curved according to the radius of the screw cap and at the same time it can be grooved in order to improve the grip.

I claim:

1. A screw cap opening device comprising a cylindrical body (1) having downwardly slanting spokes (3) formed on the inside surface thereof, said spokes having recesses, and positioned therein, upwardly turning pressing parts (2) adapted to squeeze against sides of the screw cap to be opened when said device is pressed against the top of the screw cap.

2. The device of claim 1 wherein said spokes in which said recesses are formed are inflexible.

3. The device of claim 2 wherein said pressing parts are moveable within said recesses.

4. The device of claim 1 wherein said pressing parts are formed with an outwardly projecting tip (7) which, when pressed against the top of the screw cap, is adapted to pivot said pressing parts upwards, causing a squeezing effect.

5. The device of claim 1 wherein tips of said pressing parts are equipped with grooves (5) into which an outwardly opening lock spring (4) is inserted, said spring maintaining said pressing parts in proper position relative to each other, and returning said device to a static position after use.

6. The device of claim 4 wherein said tips are equipped with grooves (5) into which an outwardly biased lock spring (4) is installed, said spring maintaining said pressing parts in proper position relative to each other, and returning said device to a static position after use.

* * * * *